US007019612B2

(12) United States Patent
Lin

(10) Patent No.: US 7,019,612 B2
(45) Date of Patent: Mar. 28, 2006

(54) FUSE SEAT FOR FILTER

(76) Inventor: Chia Ho Lin, PO Box 82-144, Taipei (TW)

( * ) Notice: Subject to any disclaimer, the term of this patent is extended or adjusted under 35 U.S.C. 154(b) by 246 days.

(21) Appl. No.: 10/735,763

(22) Filed: Dec. 16, 2003

(65) Prior Publication Data

US 2005/0128045 A1 Jun. 16, 2005

(51) Int. Cl.
*H01H 85/20* (2006.01)
*H01H 85/22* (2006.01)
*H01R 33/95* (2006.01)

(52) U.S. Cl. ..... 337/229; 337/194; 361/835; 439/622

(58) Field of Classification Search ..... 337/186, 337/194, 227–229, 256, 264, 283; 361/104, 361/833, 835; 439/366, 621, 622
See application file for complete search history.

(56) References Cited

U.S. PATENT DOCUMENTS 1,966,719 A * 7/1934 Green ..... 337/194
2,074,861 A * 3/1937 Sachs ..... 337/210
2,644,056 A * 6/1953 Curtis ..... 337/198
3,287,528 A * 11/1966 Boone ..... 337/195
4,274,698 A * 6/1981 Ahroni ..... 439/622
4,488,201 A * 12/1984 Webb et al. ..... 361/626
4,488,767 A * 12/1984 Lehman et al. ..... 439/347
4,752,243 A * 6/1988 Meidan ..... 439/622
4,834,664 A * 5/1989 Lin ..... 439/145
5,355,274 A * 10/1994 Marach et al. ..... 361/104
5,482,478 A * 1/1996 Liao ..... 439/622
5,791,941 A * 8/1998 Wang ..... 439/622
5,876,250 A * 3/1999 Deng ..... 439/622
5,984,730 A * 11/1999 Lu ..... 439/622
6,039,607 A * 3/2000 Cheung ..... 439/622
6,468,111 B1 * 10/2002 Weng ..... 439/622
6,616,484 B1 * 9/2003 Fan Wong ..... 439/622

FOREIGN PATENT DOCUMENTS

EP 1039500 A1 * 9/2000
GB 2282713 A * 4/1995

* cited by examiner

*Primary Examiner*—Anatoly Vortman

(57) ABSTRACT

A fuse seat for filter is disclosed. The fuse seat has an insertion seat for accepting a baseat body and a cavity at the bottom section of the insertion seat characterized in that a positive and a negative conductive plates are respectively mounted to the two lateral sides of the cavity and the bottom section of the cavity for contacting with the positive and negative terminal of the fuse, and one lateral wall of the cavity is provided with a guiding slot and the two lateral walls of the guiding slot are provided with positioning slots and one lateral side of the base seat body is provided with two engaging slots for engaging one end of a fuse, and between two engaging slots, a support block is mounted, and one lateral side of the support block is provided with a sliding plate allowing sliding movement within the guiding slot, and the sliding plate has a positioning protruded block for engagement at the positioning slot. The base seat body and the insertion seat are separable so that the fuse can be loaded or unloaded and the volume is greatly reduced.

5 Claims, 7 Drawing Sheets

FUSE SEAT FOR FILTER

BACKGROUND OF THE INVENTION (a) Technical Field of the Invention

The present invention relates to a fuse seat, and in particular, to a fuse seat for filter which is easily operated, and conveniently installed, has low cost in production and has a small volume.

(b) Description of the Prior Art

FIGS. 1 and 2 show a conventional fuse seat for filter comprising an insertion seat 1 having a drawer-like seat body 2.

The insertion seat 1 has a cavity 10 for holding of the seat body 2, and within the cavity 10, there are two sets of positive and negative conductive plates 11 linked to the electronic components 3 at the other side of the insertion seat 1. The electronic components 3 are externally covered by a metallic housing 30. The two lateral walls of the cavity 10 are provided with a sliding slot 12 for the sliding and engagement of the two lateral sides of the seat body.

The seat body 2 has a chamber 20 for holding of fuse 31. The two lateral sides of the seat body 2 are each protrudingly provided with a sliding block 21 so that the sliding block 21 is slidably engaged within the sliding slot 12.

The sliding block 21 is slidably engaged within the sliding slot 12 and the seat body 2 at the insert seat 1 is formed as a drawer and the fuse 31 can be inserted to the cavity 10.

The drawbacks of the conventional fuse seats are:

(1) Inconvenient in operation: As the sliding block 21 will slide and be engaged at the other end of the sliding slot 12, the seat body 2 cannot be fully withdrawn. Thus, if the fuse 31 is to be loaded the fuse 31 has to be at an inclined position to be pressed into the seat body 2. As a result, the fuse 31 may be damaged due to excessive force on cannot be fully pressed into the seat body 2. If the fuse 31 is to be unloaded, the seat body 2 cannot be withdrawn and the fuse 31 may not be unloaded, as shown in FIG. 2.

(2) The structure is complicated and installation process is laborious. The two sides of the insertion seat 1 are provided with a sliding slot 12 for the sliding block 21 to be slidably engaged, and the mounting position of the positive and negative plates 11 in the cavity 10 will be restricted. Thus, the structure is very complicated and the cost of production is greatly increased. Further, the engageably sliding of the sliding block 21 into the sliding slot 12 is not easy and therefore the installation is not convenient.

(3) Large volume and occupied space. The two sides of the insertion seat 1 should provide an appropriate sliding distance for the sliding block. Thus, an appropriate length for the sliding slot 12 is needed and therefore the size of the insertion seat 1 has to be extended and the volume of the insertion seat will be increased. Thus, a large space is needed.

Accordingly, it is an object of the present invention to provide a fuse seat for filter, which mitigates the above drawbacks.

SUMMARY OF THE INVENTION

Accordingly, it is an object of the present invention to provide a fuse seat for filter having an insertion seat and a cavity at the bottom section of the insertion seat characterized in that a positive and a negative conductive plates are respectively mounted to the two lateral sides of the cavity and the bottom section of the cavity for contacting with the positive and negative terminals of the fuse, and one lateral wall of the cavity is provided with a guiding slot and the two lateral walls of the guiding slot are provided with a positioning recess and one lateral side of the seat body is provided with two engaging slots for engaging one end of the fuse, and between two engaging slots, a support block is mounted, and one lateral side of the support block is provided with sliding plate allowing sliding movement within the guiding slot, and the sliding plate has positioning protruded blocks for engagement with the positioning slots. The seat body and the insertion seat are separable so that a fuse can be loaded or unloaded and the volume is greatly reduced.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become obvious to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
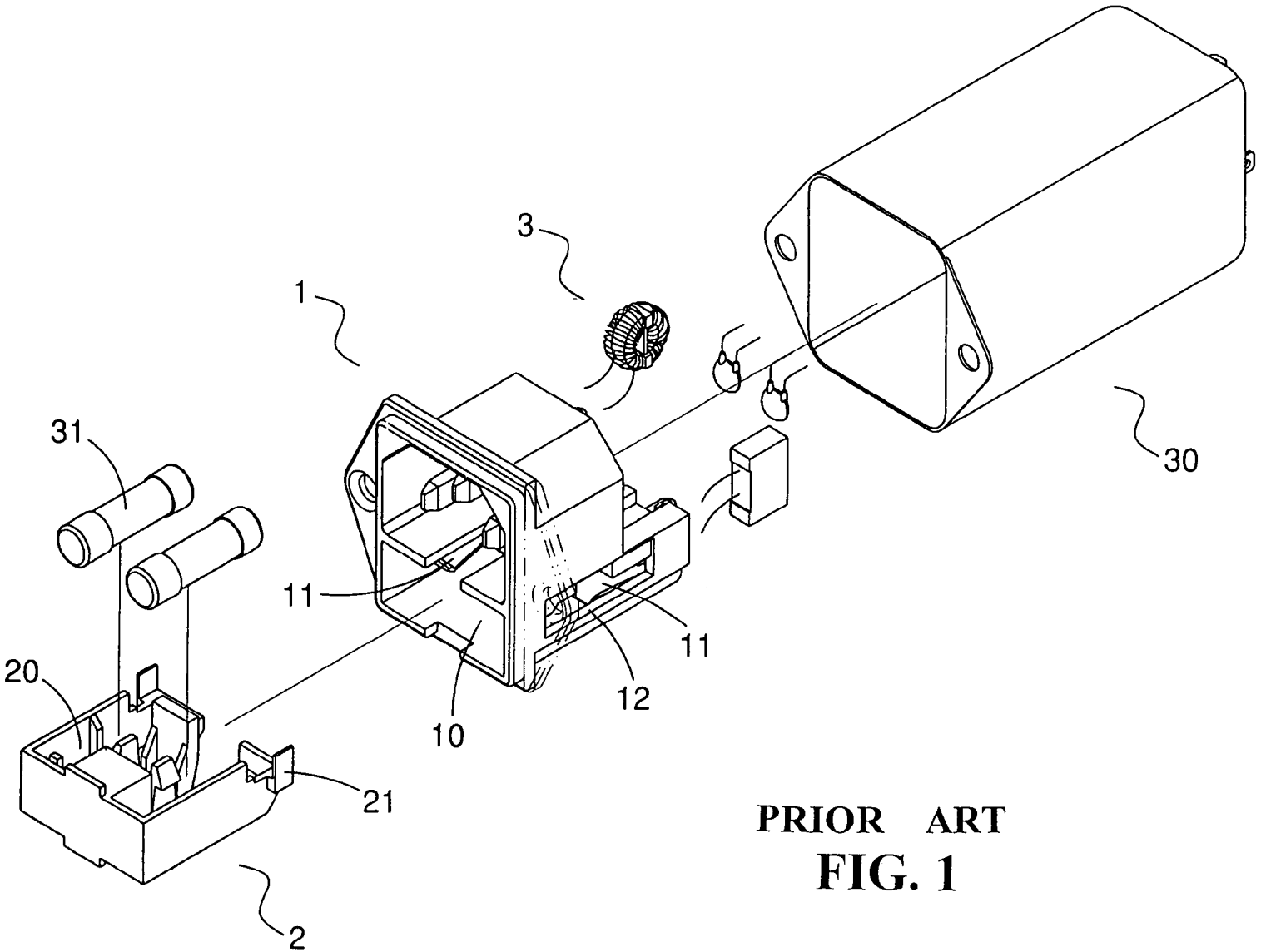
PRIOR ART FIG. 1
FIG. 1 is a perspective exploded view of a conventional fuse seat for a filter.
Figure 2:
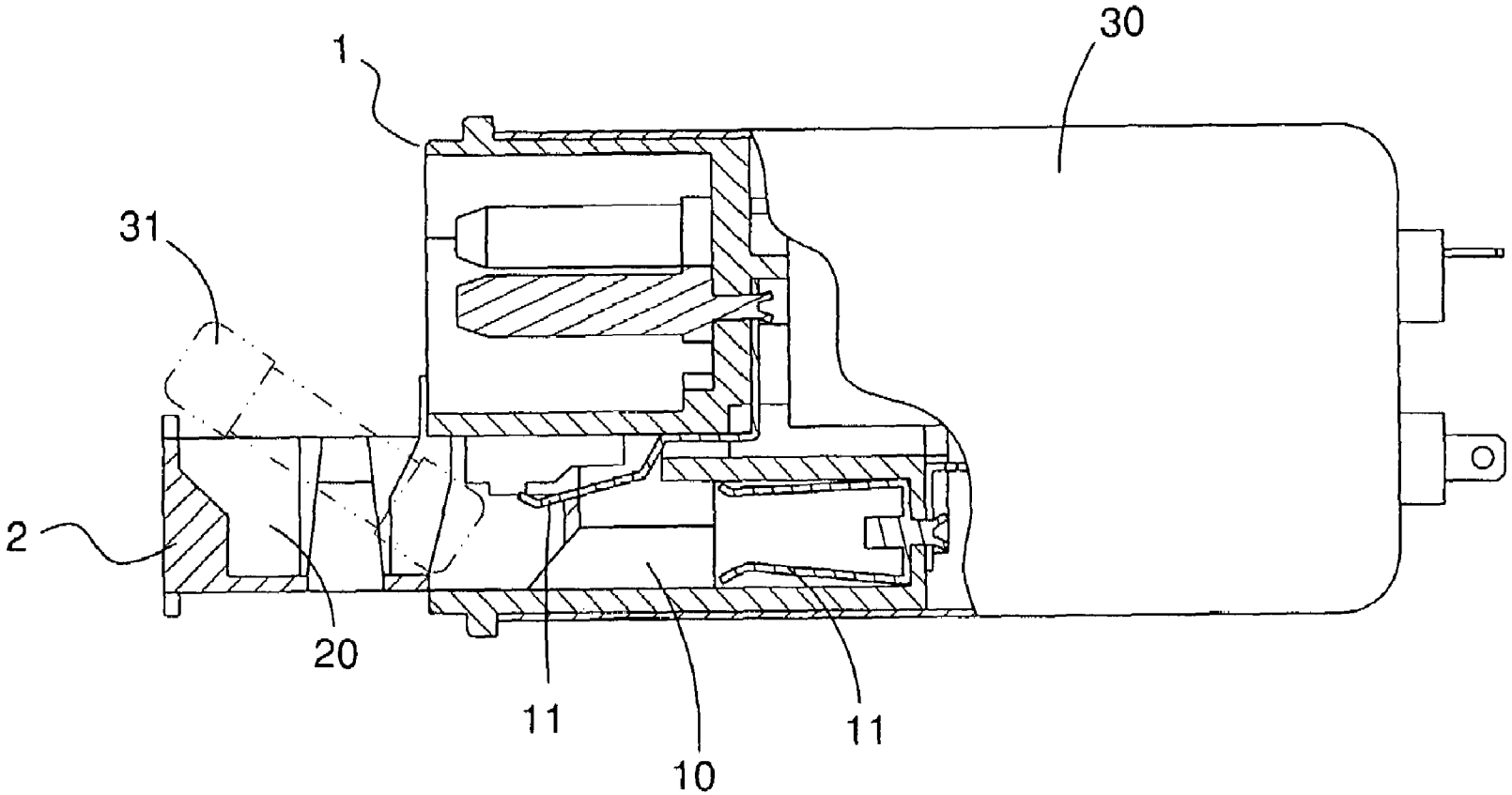
PRIOR ART FIG. 2
FIG. 2 is a partial sectional view of a conventional fuse seat for a filter.
Figure 3:
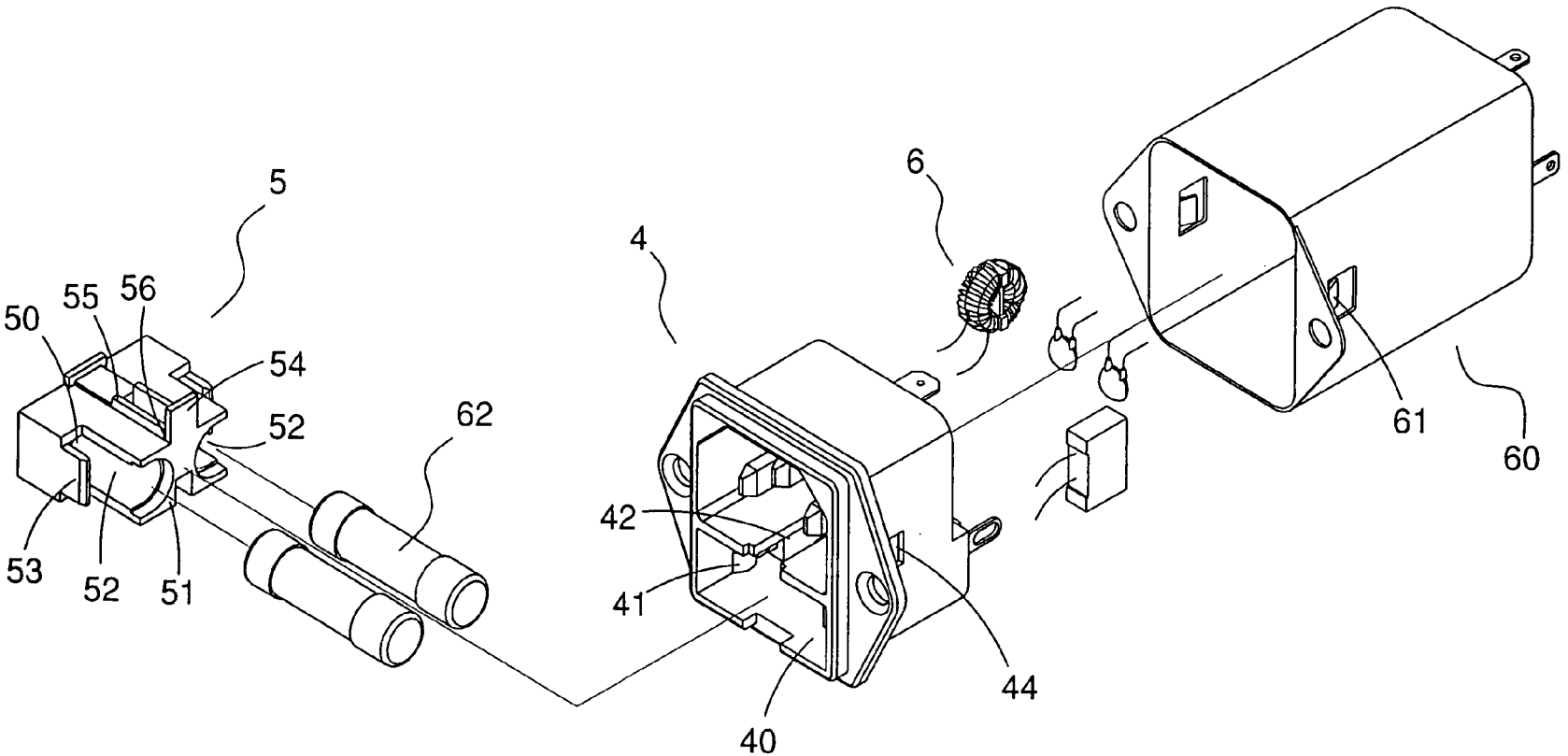
FIG. 3 is a perspective exploded view of a fuse seat for a filter of the present invention.
Figure 4:
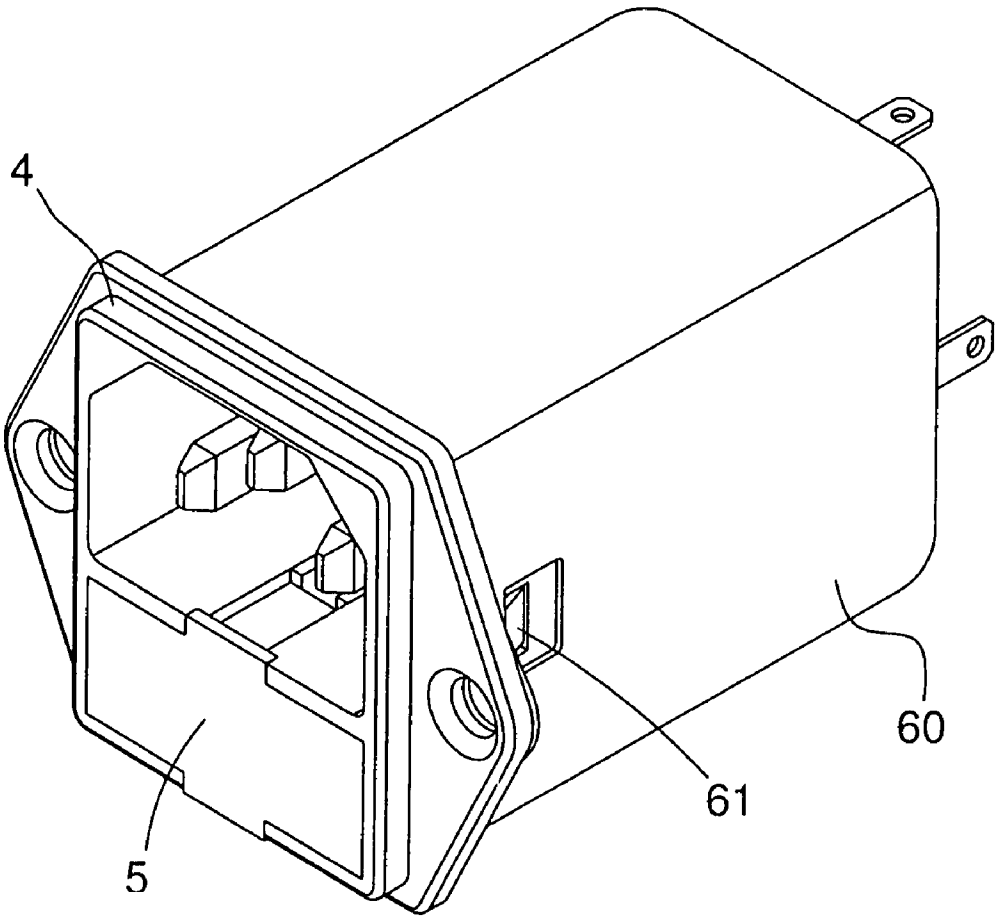
FIG. 4 is a perspective view of the fuse seat for a filter of the present invention.
Figure 5:
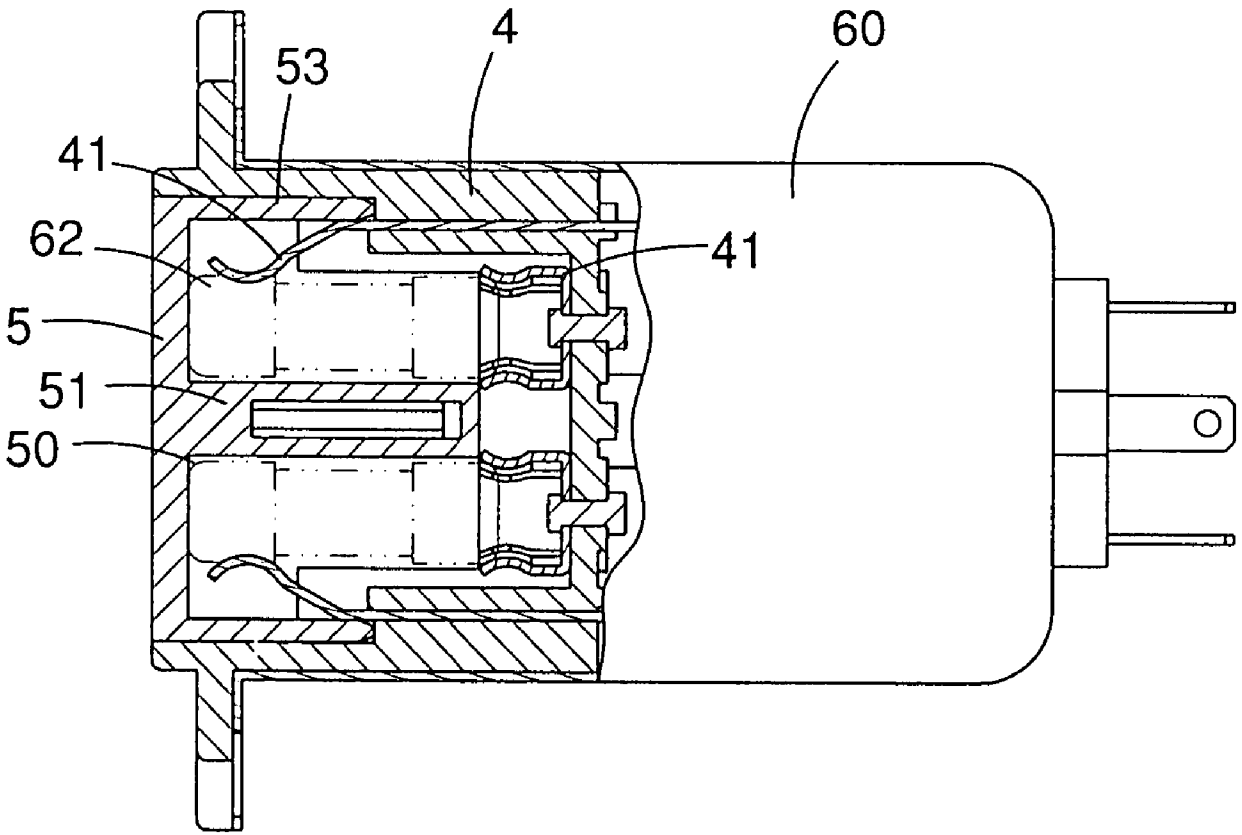
FIG. 5 is a sectional view showing engaged position of the fuse seat of the present invention.

Referring to FIGS. 3 to 5, there is shown a fuse seat for filter comprising an insertion seat 4 having a drawer-like base seat 5.

Figure 6:
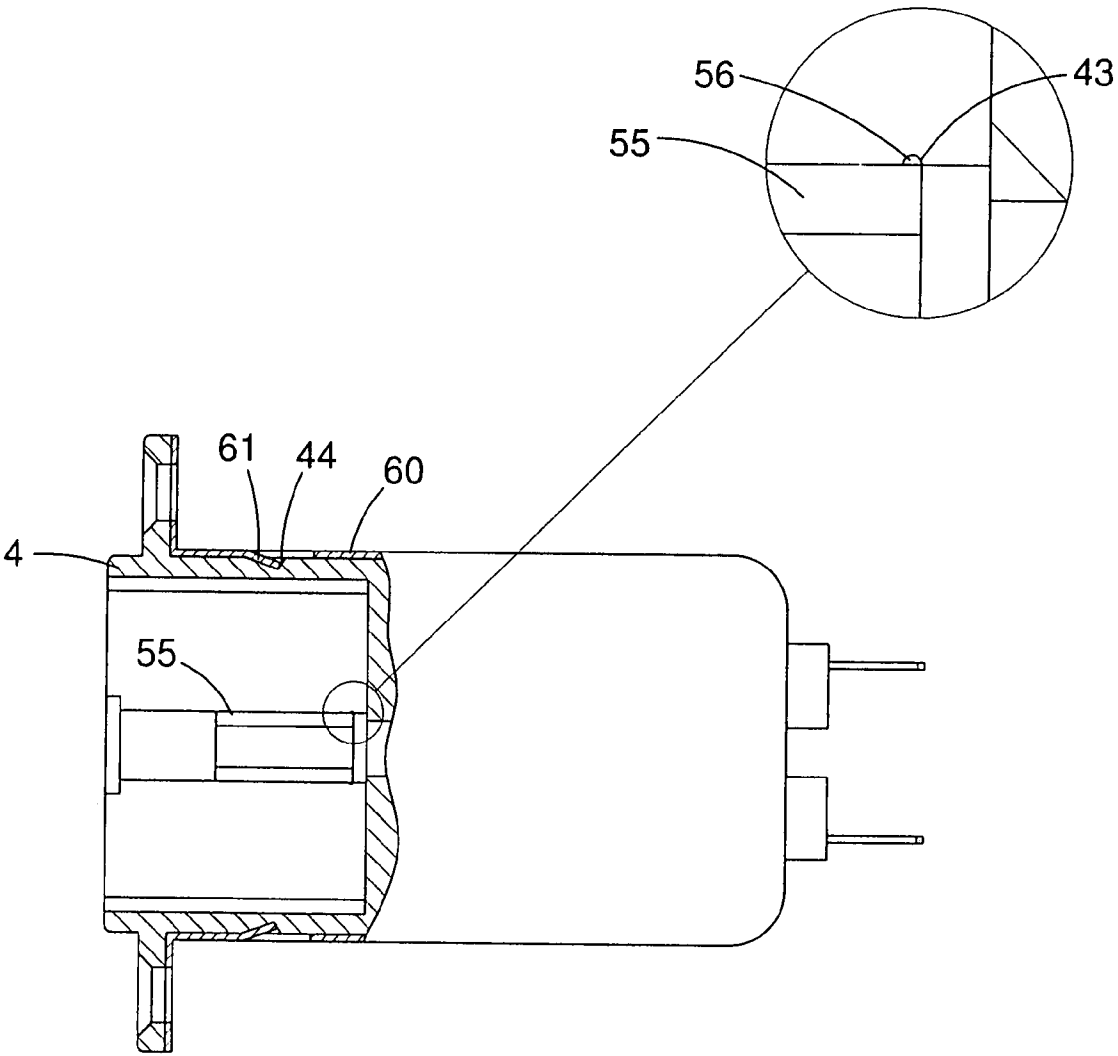
FIG. 6 is a schematic view showing the combination of the positioning protruded block with the positioning slot and the engaging plate with the engaging slot of the present invention.
Figure 7:
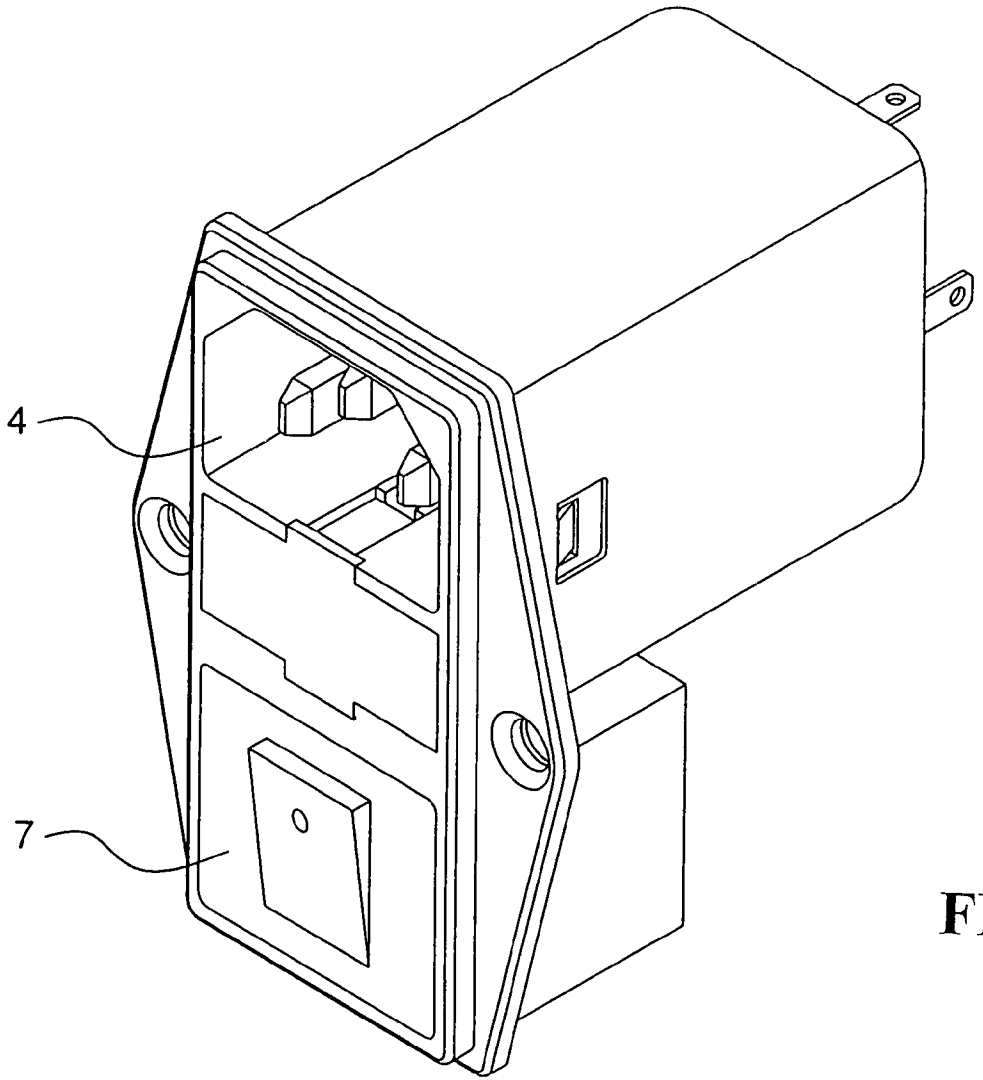
FIG. 7 is a perspective view of another preferred embodiment of the present invention.

The insertion seat 4 has a cavity 40 for holding the seat body 5. The cavity 40 contains two sets of positive and negative plates 41, and the positive and negative plates 41 are respectively mounted at the two sides and the bottom section for respectively contacting with the positive and negative terminals of the fuse 62. The other end of the positive and negative conductive plates 41 is connected to the electronic components 6 at the other side of the insertion seat 4. The exterior of the electronic component 6 is covered with a metallic housing 60. The conductive plates 41 at the two sides and the wall of the slot of the cavity 40 is provided with a gap, and the other lateral wall of the cavity 40 has a guiding slot 42 allowing the displacement of the seat body 5. The two lateral walls of the guiding slot 42 are respectively provided with a positioning slot 43. The two lateral sides of the insertion seat 4 are provided with an engaging slot 44. The metallic housing 60 has an engaging plate 61 which bent inward. The engaging plate 61 is engageable within the engaging slot 44, as shown in FIG. 6.

One lateral side of the seat body 5 is provided with two engaging slots 50 for the engagement of one end of the fuse 62. A supporting block 51 is provided between two engaging slots 50. The two lateral sides of the supporting block 51 are formed into slots 52 for engagement of the fuse 62 at the side. The end portion of the supporting block 51 is provided with a protrudingly mounted guiding block 54. Further, the supporting block 51 is provided with two sliding plates 55, and the guiding block 54 and the sliding plates 55 are slidably mounted within the guiding slot 43. The sliding plate 55 is provided with a protrudingly mounted positioning protruded block 56 which can be engaged with the positioning slot 43. The two lateral sides of the seat body 5 are respectively provided with an urging block 53 which can urge the rear section of the conductive plate 41 at the two lateral sides so that the conductive plate 41 is forward inclined and has an excellent contact with the fuse 62.

In accordance with the present invention, the advantages are as follows:

(1) Convenient in operation. Due to the fact that the seat body 5 of the filter can be fully withdrawn from the cavity 40, the replacement of the fuse 62 is very convenient. Further, the fuse 62 is inserted vertically into the engaging slot 50. Thus, the drawback of excessive force or incomplete insertion of the fuse is avoided, and the way of operation is very convenient.

(2) Installation is simple. There is no requirement of sliding slot, the mounting position of the positive and negative conductive plates 41 will not be restricted. Further, the structure is greatly simplified, the cost of production is greatly reduced. Further, the seat body 5 can be directly dislocated from the insertion seat 4, the installation of the fuse is simple.

(3) Small in volume and does not occupy a lot of space. Due to the fact that the sliding slot is not needed the length of the insertion seat 4 can be greatly reduced and therefore the volume of the fuse seat is small.

It will be understood that each of the elements described above, or two or more together may also be useful in application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fuse seat for filter comprising an insertion seat for accepting a base at body and a cavity at the bottom section of the insertion seat, wherein a positive and a negative conductive plate are respectively mounted to the two lateral sides of the cavity and the bottom section of the cavity for contacting with the positive and negative terminal of a fuse, and one lateral wall of the cavity is provided with a guiding slot and the two lateral walls of the guiding slot are provided with positioning slots and one lateral side of a base seat body is provided with two engaging slots for engaging one end of the fuse, and between two engaging slots, a support block is mounted, and one lateral side of the support block is provided with a sliding plate allowing sliding movement within the guiding slot, and the sliding plate has positioning protrude blocks for engagement with the positioning slots.

2. The fuse seat for filter of claim 1, wherein an end section of the support block is having a protrudingly mounted guiding block which is slidably positioned within the guiding slot allowing displacement of the base seat body.

3. The fuse seat for filter of claim 1, wherein the two lateral sides of the insertion seat are provided with engaging slots and a metallic housing has an engaging plate which bent inward and engageable with the engaging slot.

4. The fuse seat for filter of claim 1, wherein the two lateral sides of the base seat body having protrudingly mounted urging block which urgingly engages at a rear section of the conductive plate so that the conductive plate is inclined forward and has excellent contact with the fuse.

5. The fuse seat for filter of claim 1, wherein the insertion seat comprising a press switch.

* * * * *